US009129572B2

(12) United States Patent
Choi et al.

(10) Patent No.: US 9,129,572 B2
(45) Date of Patent: Sep. 8, 2015

(54) DISPLAY DEVICE AND RELATED METHOD

(75) Inventors: Yong-Jun Choi, Asan-si (KR); Jae-Suk Choi, Uijeongbu-si (KR); Seung Hwan Moon, Asan-si (KR); Po-Yun Park, Seoul (KR); Min Joo Lee, Seoul (KR); Jung Hwan Cho, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 287 days.

(21) Appl. No.: 13/569,160

(22) Filed: Aug. 7, 2012

(65) Prior Publication Data

US 2013/0215094 A1 Aug. 22, 2013

(30) Foreign Application Priority Data

Feb. 21, 2012 (KR) ..... 10-2012-0017618

(51) Int. Cl.

| | |
|---|---|
| ***G09G 3/36*** | (2006.01) |
| ***G09G 5/36*** | (2006.01) |
| ***G09G 3/20*** | (2006.01) |
| *G09G 3/32* | (2006.01) |

(52) U.S. Cl.

CPC ..... *G09G 5/363* (2013.01); *G09G 3/2025* (2013.01); *G09G 3/3696* (2013.01); *G09G 3/3266* (2013.01); *G09G 2300/0866* (2013.01); *G09G 2310/061* (2013.01); *G09G 2320/0214* (2013.01); *G09G 2320/0247* (2013.01); *G09G 2330/021* (2013.01); *G09G 2330/022* (2013.01)

(58) Field of Classification Search

CPC combination set(s) only.
See application file for complete search history.

(56) References Cited

U.S. PATENT DOCUMENTS

| | | | |
|---|---|---|---|
| 6,005,542 | A | 12/1999 | Yoon |
| 7,102,604 | B2 | 9/2006 | Hong |
| 7,112,996 | B2 | 9/2006 | Lee |
| 7,362,295 | B2 | 4/2008 | Park et al. |
| 7,489,295 | B2 | 2/2009 | Honbo |
| 7,545,354 | B2 | 6/2009 | Ha et al. |
| 7,545,654 | B2 | 6/2009 | Berghegger |
| 7,580,032 | B2 | 8/2009 | Jung et al. |
| 7,612,505 | B2 | 11/2009 | Min et al. |
| 7,724,218 | B2 | 5/2010 | Kim et al. |
| 7,907,106 | B2 | 3/2011 | Shin et al. |

(Continued)

FOREIGN PATENT DOCUMENTS

| | | | |
|---|---|---|---|
| EP | 0838801 | A1 | 4/1998 |
| JP | 06-267660 | A | 9/1994 |

(Continued)

OTHER PUBLICATIONS

Machine translation Japan Tomoaki Sekime on Apr. 28, 1998.*

*Primary Examiner* — Linh N Hoffner
(74) *Attorney, Agent, or Firm* — Innovation Counsel LLP

(57) ABSTRACT

A display device includes a display panel that includes a first pixel and a second pixel, the first pixel being associated with a positive pixel voltage relative to a data voltage and being associated with a first leakage current, the second pixel being associated with a negative pixel voltage relative to the data voltage and being associated with a second leakage current. The display device further includes a gate driver for providing a first gate-off voltage having a first value to at least one of the first pixel and the second pixel, the first value being in a range determined based on an equality-enabling value, wherein a value of the first leakage current is equal to a value of the second leakage current if the first gate-off voltage having the equality-enabling value is provided to the at least one of the first pixel and the second pixel.

16 Claims, 11 Drawing Sheets

(56) References Cited

U.S. PATENT DOCUMENTS

| | | | | |
|---|---|---|---|---|
| 8,692,823 | B2 | 4/2014 | Toyotaka et al. | |
| 2001/0024187 | A1 | 9/2001 | Sato et al. | |
| 2002/0067332 | A1* | 6/2002 | Hirakata et al. | 345/102 |
| 2003/0030607 | A1 | 2/2003 | Kitagawa et al. | |
| 2004/0169627 | A1 | 9/2004 | Hong | |
| 2004/0179002 | A1 | 9/2004 | Park et al. | |
| 2005/0068289 | A1 | 3/2005 | Diefenbaugh et al. | |
| 2005/0219196 | A1* | 10/2005 | Lee | 345/100 |
| 2005/0253798 | A1 | 11/2005 | Hiyama et al. | |
| 2006/0038771 | A1* | 2/2006 | Hirakata et al. | 345/102 |
| 2007/0091204 | A1 | 4/2007 | Koshimizu et al. | |
| 2007/0103424 | A1 | 5/2007 | Huang | |
| 2007/0132683 | A1 | 6/2007 | Kong | |
| 2007/0139427 | A1 | 6/2007 | Sahashi | |
| 2007/0176883 | A1 | 8/2007 | Hsu et al. | |
| 2008/0079701 | A1 | 4/2008 | Shin et al. | |
| 2008/0084379 | A1 | 4/2008 | Takahashi et al. | |
| 2008/0100553 | A1 | 5/2008 | Shen et al. | |
| 2008/0224983 | A1 | 9/2008 | Lee et al. | |
| 2009/0096769 | A1 | 4/2009 | Kim et al. | |
| 2009/0244112 | A1 | 10/2009 | Jung et al. | |
| 2010/0165145 | A1 | 7/2010 | Kuroki | |
| 2010/0201677 | A1* | 8/2010 | Takei et al. | 345/213 |
| 2010/0238193 | A1 | 9/2010 | Neal et al. | |
| 2010/0302265 | A1 | 12/2010 | Sumi | |
| 2011/0025910 | A1 | 2/2011 | Furukawa et al. | |
| 2011/0148826 | A1 | 6/2011 | Koyama et al. | |
| 2011/0157253 | A1 | 6/2011 | Yamazaki et al. | |
| 2011/0227955 | A1 | 9/2011 | Lee et al. | |
| 2012/0268446 | A1* | 10/2012 | Yamauchi | 345/212 |
| 2012/0320004 | A1* | 12/2012 | Kitakado | 345/204 |
| 2013/0027379 | A1 | 1/2013 | Lee et al. | |

FOREIGN PATENT DOCUMENTS

| | | | |
|---|---|---|---|
| JP | 06-333695 | A | 12/1994 |
| JP | 07-191298 | A | 7/1995 |
| JP | 09-101506 | A | 4/1997 |
| JP | 10-111490 | | 4/1998 |
| JP | 2001-013930 | A | 1/2001 |
| JP | 2004-061782 | | 2/2004 |
| JP | 2005-091385 | A | 4/2005 |
| JP | 2005-234032 | A | 9/2005 |
| JP | 3718832 | | 9/2005 |
| JP | 2006-073199 | A | 3/2006 |
| JP | 2006-091242 | A | 4/2006 |
| JP | 2006-228312 | A | 8/2006 |
| JP | 2007-039759 | | 2/2007 |
| JP | 2007-267038 | A | 10/2007 |
| JP | 2008-098710 | A | 4/2008 |
| JP | 2009-069373 | | 4/2009 |
| JP | 2009-075580 | | 4/2009 |
| JP | 2010-066725 | A | 3/2010 |
| JP | 4469788 | | 3/2010 |
| JP | 4586052 | | 9/2010 |
| JP | 2010-273259 | A | 12/2010 |
| KR | 10-2002-0072504 | A | 9/2002 |
| KR | 10-0374375 | | 2/2003 |
| KR | 10-0400595 | | 9/2003 |
| KR | 10-0480815 | | 3/2005 |
| KR | 10-2006-0058421 | | 5/2006 |
| KR | 10-2006-0066424 | A | 6/2006 |
| KR | 10-2007-0039759 | | 4/2007 |
| KR | 10-2007-0066013 | | 6/2007 |
| KR | 10-2007-0076078 | A | 7/2007 |
| KR | 10-0767868 | | 10/2007 |
| KR | 10-0770543 | | 10/2007 |
| KR | 10-2008-0002427 | A | 1/2008 |
| KR | 10-2008-0035333 | | 4/2008 |
| KR | 10-0834119 | | 5/2008 |
| KR | 10-0840331 | | 6/2008 |
| KR | 10-0848953 | | 7/2008 |
| KR | 10-2010-0131671 | A | 12/2010 |
| KR | 10-2011-0070178 | A | 6/2011 |
| KR | 10-2013-0012381 | A | 7/2011 |

* cited by examiner

DISPLAY DEVICE AND RELATED METHOD

CROSS-REFERENCE TO RELATED APPLICATION

This application claims priority to and the benefit of Korean Patent Application No. 10-2012-0017618 filed in the Korean Intellectual Property Office on Feb. 21, 2012, the entire contents of the prior application being incorporated herein by reference.

BACKGROUND OF THE INVENTION (a) Field of the Invention

The present invention relates to display devices. More particularly, the invention is related display devices capable of minimizing energy consumption and/or capable of preventing undesirable flicker.

(b) Description of the Related Art

Typically, display devices are required for computer monitors, televisions, and mobile phones. Display devices may include cathode ray tube display devices, liquid crystal displays, and plasma display devices.

A display device may include a graphic processing unit (GPU), a display panel, and a signal controller. The graphic processing unit may transmit image data to the signal controller. The signal controller may generate a control signal for driving the display panel and may transmit the control signal together with the image data to the display panel. The display panel may display an image according to the control signal and the image data.

Images displayed on the display panel may be classified into still images and motion pictures. In general, the display panel may display several frames per second. If the frames include the same image data from frame to frame, a still image may be displayed. On the other hand, if the frames include different image data from frame to frame, a motion picture may be displayed.

Conventionally, the graphic processing unit may be configured to transmit image data to the signal controller for every frame even when a still image, a substantial amount of power may be unnecessarily wasted because the same image data is repeatedly transmitted.

Methods for minimizing energy consumption of the display device have been implemented. For example, a method called the panel self-refresh (PSR) mode involves storing image data of a still image in a frame memory in the signal controller and providing the stored image data to the display panel while displaying the still image. In the PSR) mode, since the graphic processing unit does not need to repeatedly transmit the image data while a still image is to be displayed, the graphic processing unit may be inactivated for reducing the energy consumption of the display device.

Nevertheless, for implementing the PSR mode, the additional frame memory may increase the energy consumption of the display device.

The above information disclosed in this Background section is only for enhancement of understanding of the background of the invention. This Background section may contain information that does not form the prior art that is already known in this country to a person of ordinary skill in the art.

SUMMARY OF THE INVENTION

An embodiment of the present invention is related to a display device having advantages of reduced energy consumption and reduced flicker.

An embodiment of the invention is related to a display device that may include a data line configured to transmit a data voltage. The display device may further include a display panel that includes a first pixel and a second pixel, the first pixel being associated with a first pixel voltage that is positive relative to the data voltage, the first pixel being further associated with a first leakage current, the second pixel being associated with a second pixel voltage that is negative relative to the data voltage, the second pixel being further associated with a second leakage current. The display device may further include a gate line. The display device may further include a gate driver configured to provide a first gate-off voltage having a first value through the gate line to at least one of the first pixel and the second pixel when the display panel displays a still image, the first value being in a range that is determined based on an equality-enabling value, wherein the value of the first leakage current is substantially equal to the value of the second leakage current if the first gate-off voltage having the equality-enabling value is provided to the at least one of the first pixel and the second pixel.

In one or more embodiments, the maximum value of the range is equal to the equality-enabling value plus 20% of an absolute value of the equality-enabling value.

In one or more embodiments, the maximum value of the range is equal to the equality-enabling value plus 10% of an absolute value of the equality-enabling value.

In one or more embodiments, the minimum value of the range is equal to the equality-enabling value minus 20% of an absolute value of the equality-enabling value.

In one or more embodiments, the minimum value of the range is equal to the equality-enabling value minus 10% of an absolute value of the equality-enabling value.

In one or more embodiments, the first value is equal to the equality-enabling value.

In one or more embodiments, the gate driver is further configured to provide a second gate-off voltage having a second value through the gate line to the at least one of the first pixel and the second pixel when the display panel displays a motion picture. In one or more embodiments, the second value may be lower than the first value. In one or more embodiments, the second value may be in the aforementioned range. In one or more embodiments, the second value may be equal to the first value.

In one or more embodiments, the first pixel may include a switching element that includes an input terminal and an output terminal. The first leakage current may exist between the input terminal and the output terminal when the switching element receives the first gate-off voltage.

In one or more embodiments, the still image may be associated with a first frame length and a first vertical blank period length. The display panel may be configured to display a motion picture that is associated with a second frame length and a second vertical blank period length. The first vertical blank period length may be equal to a sum of two times the second frame length and the second vertical blank period length.

In one or more embodiments, the still image may be associated with a first frame length and a first effective period length. The display panel may be configured to display a motion picture that is associated with a second frame length and a second effective period length. The first effective period length may be equal to a sum of the second frame length and the second effective period length.

An embodiment of the invention is related to a method for configuring a display device. The method may include providing a data line for transmitting a data voltage. The method may further include providing a display panel that includes a first pixel and a second pixel, the first pixel being associated with a first pixel voltage that is positive relative to the data voltage, the first pixel being further associated with a first leakage current, the second pixel being associated with a second pixel voltage that is negative relative to the data voltage, the second pixel being further associated with a second leakage current. The method may further include providing a gate line. The method may further include providing a gate driver for supplying a first gate-off voltage having a first value through the gate line to at least one of the first pixel and the second pixel when the display panel displays a still image. The method may further include setting the first value such that the first value is in a range that is determined based on an equality-enabling value, wherein a value of the first leakage current is substantially equal to a value of the second leakage current if the first gate-off voltage having the equality-enabling value is supplied to the at least one of the first pixel and the second pixel.

In one or more embodiments, the maximum value of the range is equal to the equality-enabling value plus 20% of an absolute value of the equality-enabling value.

In one or more embodiments, the maximum value of the range is equal to the equality-enabling value plus 20% of an absolute value of the equality-enabling value.

In one or more embodiments, the maximum value of the range is equal to the equality-enabling value plus 10% of an absolute value of the equality-enabling value.

In one or more embodiments, the minimum value of the range is equal to the equality-enabling value minus 20% of an absolute value of the equality-enabling value.

In one or more embodiments, the minimum value of the range is equal to the equality-enabling value minus 10% of an absolute value of the equality-enabling value.

In one or more embodiments, the method may further include setting the first value such that the first value is equal to the equality-enabling value.

In one or more embodiments, the gate driver is further configured to provide a second gate-off voltage having a second value through the gate line to the at least one of the first pixel and the second pixel when the display panel displays a motion picture. In one or more embodiments, the method may further include setting the second value such that the second value is lower than the first value. In one or more embodiments, the method may further include setting the second value such that the second value is in the aforementioned range.

An embodiment of the present invention is related to a display device that includes the following components: a display panel for displaying at least one of a still image and a motion picture; a signal controller controlling signals for driving the display panel; and a graphic processing unit transmitting input image data to the signal controller, in which the display panel is driven at a first frequency when the motion picture is displayed and the display panel is driven at a second frequency lower than the first frequency when the still image is displayed and the display panel includes gate lines and data lines; a switching element of which a control terminal is connected to the gate line and an input terminal is connected to the data line; and a pixel electrode connected to an output terminal of the switching element, in which a gate signal including gate-on voltage and gate-off voltage is applied to the gate line and the gate-off voltage when the display panel is driven at the second frequency has the following range. $Va-0.2|Va|\leq Voff2\leq Va+0.2|Va|$ (Voff2: the gate-off voltage when the display panel is driven at the second frequency, Va: voltage of the control terminal of the switching element when leakage current flowing between the input terminal and the output terminal of the switching element when the positive pixel voltage is applied to the pixel electrode and leakage current flowing between the input terminal and the output terminal of the switching element when the negative pixel voltage is applied to the pixel electrode are the same as each other)

The gate-off voltage when the display panel may be driven at the second frequency has the following range. $Va-0.1|Va|\leq Voff2\leq Va+0.1|Va|$ (Voff2: the gate-off voltage when the display panel is driven at the second frequency, Va: voltage of the control terminal of the switching element when leakage current flowing between the input terminal and the output terminal of the switching element when the positive pixel voltage is applied to the pixel electrode and leakage current flowing between the input terminal and the output terminal of the switching element when the negative pixel voltage is applied to the pixel electrode are the same as each other)

The gate-off voltage when the display panel is driven at the first frequency has the following range. $Va-0.2|Va|\leq Voff1\leq Va+0.2|Va|$ (Voff1: the gate-off voltage when the display panel is driven at the first frequency, Va: voltage of the control terminal of the switching element when leakage current flowing between the input terminal and the output terminal of the switching element when the positive pixel voltage is applied to the pixel electrode and leakage current flowing between the input terminal and the output terminal of the switching element when the negative pixel voltage is applied to the pixel electrode are the same as each other)

The gate-off voltage when the display panel is driven at the first frequency has the following range. $Va-0.1|Va|\leq Voff1\leq Va+0.1|Va|$ (Voff1: the gate-off voltage when the display panel is driven at the first frequency, Va: voltage of the control terminal of the switching element when leakage current flowing between the input terminal and the output terminal of the switching element when the positive pixel voltage is applied to the pixel electrode and leakage current flowing between the input terminal and the output terminal of the switching element when the negative pixel voltage is applied to the pixel electrode are the same as each other)

The gate-off voltage when the display panel is driven at the first frequency may be the same as the gate-off voltage when the display panel is displayed at the second frequency.

The gate-off voltage when the display panel is driven at the first frequency may be lower than the gate-off voltage when the display panel is displayed at the second frequency.

The signal controller may include a frame memory storing image data received from the graphic processing unit.

The graphic processing unit may transmit a still image start signal and a still image end signal to the signal controller.

The display device may further include a gate driver driving the gate line; and a data driver driving the data line, in which the signal controller may store the input image data in the frame memory, apply storage image data stored in the frame memory to the data driver, and inactivate the transmission of the input image data, when the still image start signal is applied.

The transmission of the input image data may be activated and the input image data may be applied to the data driver when the still image end signal is applied.

A length of a vertical blank period when the display panel is driven at the second frequency may be longer than a length of the vertical blank period when the display panel is at the first frequency.

The display panel may be driven at a frequency higher than the second frequency and lower than the first frequency for m frame after the still image start signal is applied.

The length of the vertical blank period may be gradually increased for the m frame.

The display panel may be driven at a frequency higher than the second frequency and lower than the first frequency for n frame after the still image end signal is applied.

The length of the vertical blank period may be gradually decreased for the n frame.

A clock frequency of the gate signal when the display panel is driven at the second frequency may be lower than the clock frequency of the gate signal when the display panel is driven at the first frequency.

A length of a vertical blank period when the display panel is driven at the second frequency may be longer than a length of the vertical blank period when the display panel is driven at the first frequency, and a clock frequency of the gate signal when the display panel is driven at the second frequency may be lower than the clock frequency of the gate signal when the display panel is driven at the first frequency.

The gate driver may be attached to one side of the display panel.

The gate driver may be mounted in the display panel together with the gate line, the data line, and the switching element.

The display device according to the embodiment of the present invention has the effects as follows.

According to one or more embodiments of the present invention, the display device is driven at a first frequency when a motion picture is displayed, and the display device is driven at a second frequency lower than the first frequency when a still image is displayed. Advantageously, energy consumption may be reduced.

In one or more embodiments, the gate driver of the display device may provide an optimized gate-off voltage such that the leakage current value associated with a positive pixel and the leakage current value associated with a negative pixel may be substantially equal. Advantageously, undesirable flicker may be prevented, and the display device may display images with satisfactory quality.

DETAILED DESCRIPTION OF THE EMBODIMENTS

Figure 1:
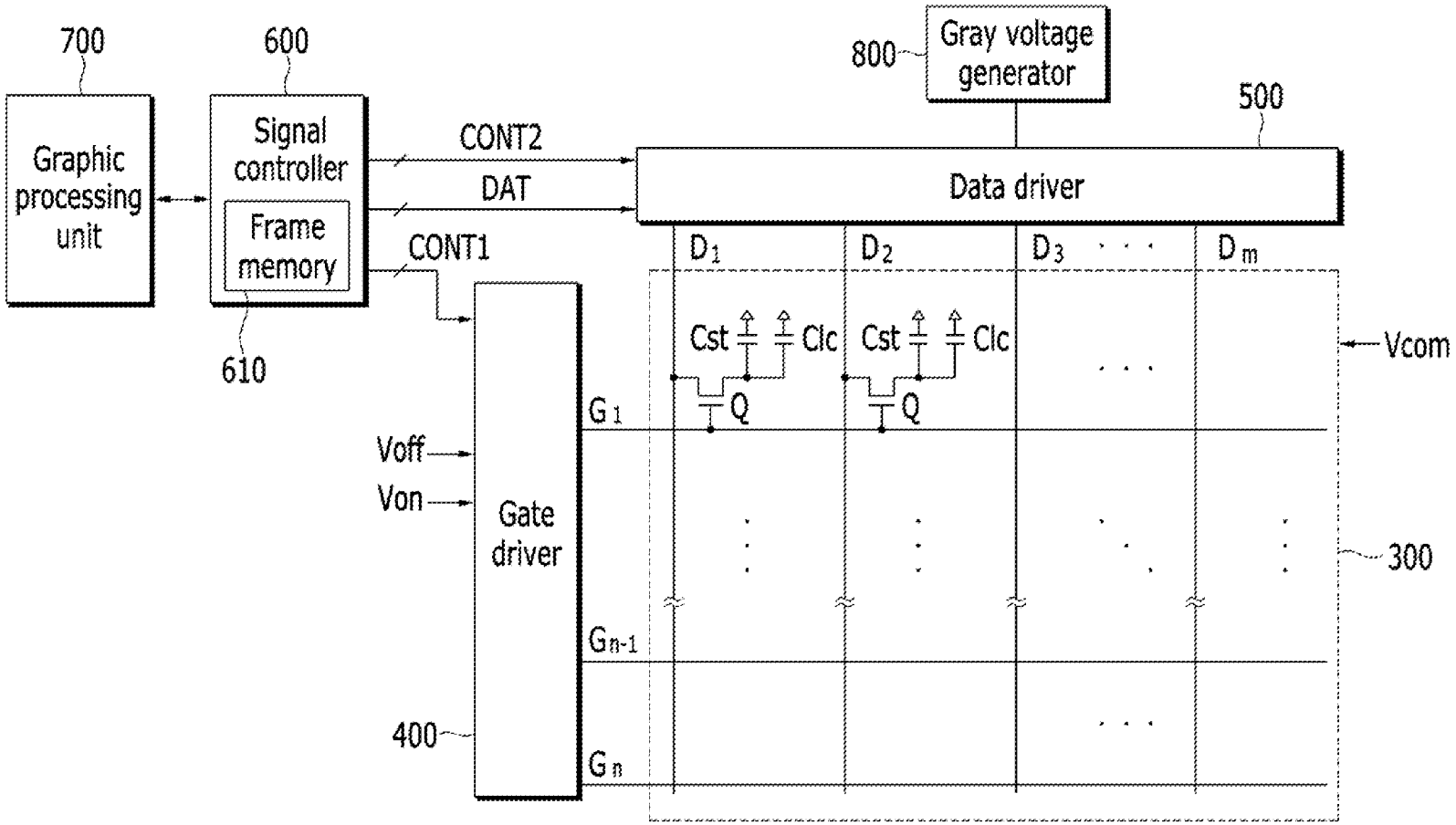
FIG. 1 is a block diagram illustrating a display device according to one or more embodiments of the present invention.

The present invention will be described more fully hereinafter with reference to the accompanying drawings, in which embodiments of the invention are illustrated. As those skilled in the art would realize, the described embodiments may be modified in various different ways, all without departing from the spirit or scope of the present invention.

In the drawings, the thickness of layers, films, panels, regions, etc., may be exaggerated for clarity. Like reference numerals may designate like elements throughout the specification. It will be understood that when an element such as a layer, film, region, or substrate is referred to as being "on" another element, it can be directly on the other element or at least one intervening element may be present. In contrast, when an element is referred to as being "directly on" another element, there are no intervening elements present.

FIG. 1 is a block diagram illustrating a display device according to one or more embodiments of the present invention.

As illustrated in FIG. 1, the display device may include a display panel 300 for displaying an image, a signal controller 600 configured to provide controlling signals for driving the display panel 300, and a graphic processing unit 700 for transmitting input image data to the signal controller 600.

The display panel 300 may display still images and may display motion pictures. If input image data is the same for a plurality of sequential frames, a still image may be displayed; if input image data is different for a plurality of sequential frames, a motion picture may be displayed.

The display panel 300 may include a plurality of gate lines G1-Gn and a plurality of data lines D1-Dm. The plurality of gate lines G1-Gn may extend in a horizontal direction. The plurality of data lines D1-Dm may extend in a vertical direction and may cross the plurality of gate lines G1-Gn.

A gate line of the gate lines G1-Gn and a data line of the data lines D1-Dm may be electrically connected a switching element Q in a pixel. A control terminal of the switching element Q is electrically connected to the gate, an input terminal of the switching element Q is electrically connected with the data line, and an output terminal of the switching element Q is connected with a liquid crystal capacitor Clc and a storage capacitor Cst.

The display panel 300 illustrated in FIG. 1 may be a liquid crystal panel or a display panel implemented using one or more of various other display technologies.

The signal controller 600 may process input image data received from the graphic processing unit 700. The signal controller 600 may generate control signals suitable for the operation condition of the liquid crystal panel 300 in response to the input image data. The input image data may include one or more of a vertical synchronization signal Vsync, a horizontal synchronization signal Hsync, a main clock signal MCLK, a data enable signal DE, and so on. The control signals may include a gate control signal CONT1 and a data control signal CONT2.

The gate control signal CONT1 includes one or more of a vertical synchronization start signal STV instructing an output start of a gate-on pulse (high time of a gate signal GS), a gate clock signal CPV controlling an output time of the gate-on pulse, and so on.

The data control signal CONT2 includes one or more of a horizontal synchronization start signal STH instructing an input start of the image data DAT, a load signal TP instructing application of the corresponding data voltages to the data lines D1-Dm, and so on.

The signal controller 600 provides control signals for driving the display panel 300 at a first frequency when the display panel 300 is to display a motion picture and provides control signals for driving the display panel 300 at a second frequency when the display panel 300 is to display a still image. The second frequency may be lower than the first frequency.

For example, the first frequency may be 60 Hz, which means that 60 frames are displayed per second. The second frequency may be 10 Hz, which means that 10 frames are displayed per second.

The signal controller 600 may implement the first frequency and the second frequency using one or more of various methods. For example, the various methods include a method of changing a clock frequency of a gate signal, a method of changing a length of a vertical blank period, a method of changing a clock frequency of a gate signal and changing a length of a vertical blank period at the same time, and so on. Examples of the methods will be described below with reference to FIGS. 2 to 5.

Figure 2:
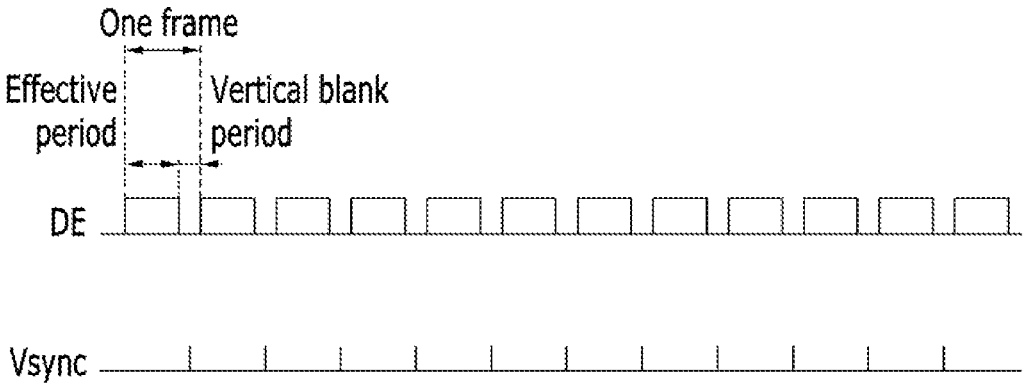
FIG. 2 is a diagram illustrating a DE signal and a Vsync signal used in the display device according to one or more embodiments of the present invention.
Figure 3:
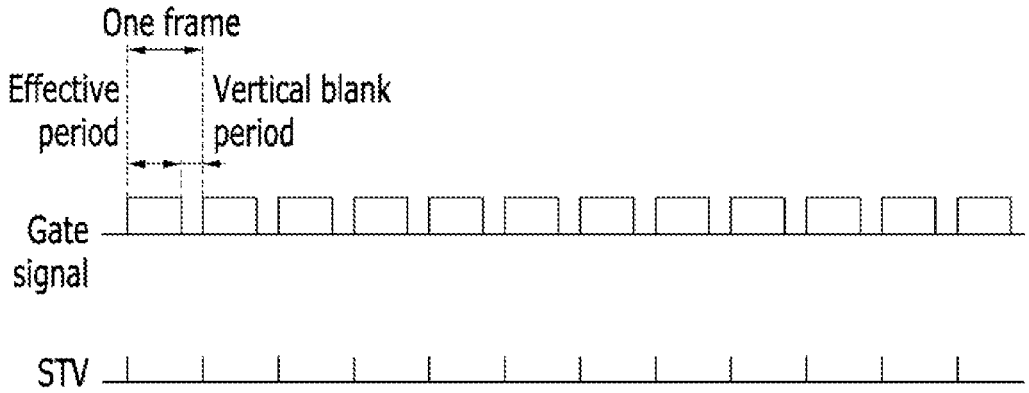
FIG. 3 is a diagram illustrating a gate signal and an STV signal when a display panel of the display device is driven at a first frequency according to one or more embodiments of the present invention.
Figure 4:
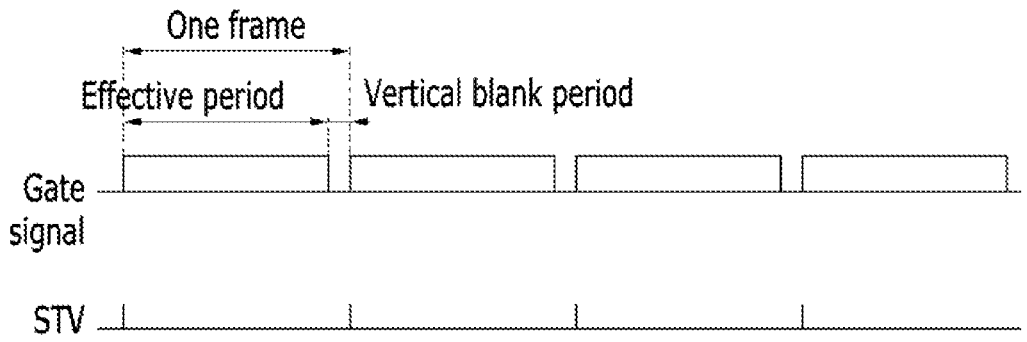
FIGS. 4 to 6 are diagrams illustrating a gate signal and an STV signal when a display panel of the display device is driven at a second frequency according to one or more embodiments of the present invention.
Figure 5:
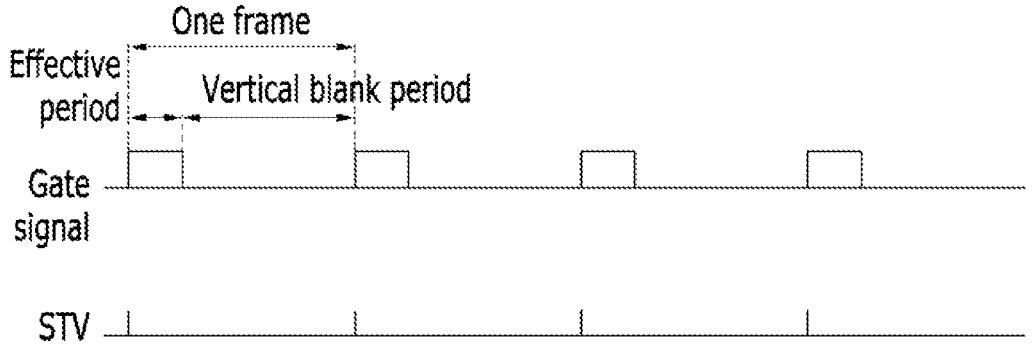
Figure 6:
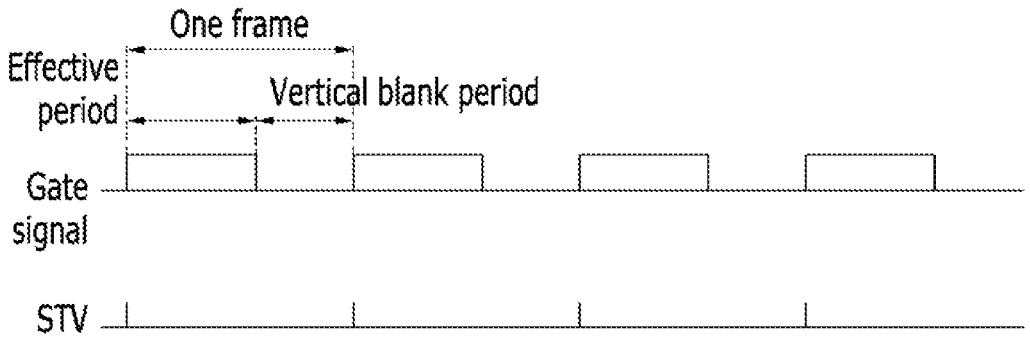

FIG. 2 is a diagram illustrating a DE signal (data enable signal) and a Vsync signal used in the display device according to one or more embodiments of the present invention. FIG. 3 is a diagram illustrating a gate signal and an STV signal when a display panel of the display device is driven at a first frequency according to one or more embodiments of the present invention. FIGS. 4 to 6 are diagrams illustrating a gate signal and an STV signal when a display panel of the display device is driven at a second frequency according to one or more embodiments of the present invention.

As illustrated in FIG. 2, one frame may include an effective period in which image data is transmitted and a vertical blank period in which image data is not transmitted. Image data of two adjacent frames may be separated by the vertical blank period.

As illustrated in FIG. 3, when the display panel 300 is driven at the first frequency, the gate signal is supplied in the effective period so that pixel voltage (or data voltage) corresponding to the image data may be applied. A gate-off state may be maintained in the vertical blank period.

As illustrated in FIG. 4, when the display panel 300 is driven at the second frequency, a length of one frame is increased as compared with the time when the display panel 300 is driven at the first frequency. In one or more embodiments, the first frequency is 60 Hz, and the second frequency is 20 Hz. As illustrated in FIG. 4, when the display panel 300 is driven at the second frequency, the length of one frame (a second frame length) may be three times the length of one frame (a first frame length) when the display panel 300 is driven at the first frequency. In one or more embodiments, the length of the effective period (a second effective period length) when the display panel 300 is driven at the second frequency is three or more times the length of the effective period (a first effective period length) when the display panel 300 is driven at the first frequency. In one or more embodiments, the second effective period length may be substantially equal to three times the first effective period length plus two times a first vertical blank period length (i.e., the length of the vertical blank period when the display panel 300 is driven at the first frequency). In order to increase the length of the effective period, the clock frequency of the gate signal may be increased to about three or more times the clock frequency associated with the first frequency. In one or more embodiments, the length of the vertical blank period (the first vertical blank period length) when the display panel 300 is driven at the first frequency may be substantially equal to the length of the vertical blank period (a second vertical blank period length) when the display panel 300 is driven at the second frequency.

FIG. 5, as analogous to FIG. 4, illustrates that the length of one frame (the second frame length) when the display panel 300 is driven at the second frequency may be substantially equal to three times the length of one frame (the first frame length) when the display panel 300 is driven at the first frequency. Unlike FIG. 4, in one or more embodiments, as illustrated in FIG. 5, the length of the effective period (the second effective period length) when the display panel 300 is driven at the second frequency may be substantially equal to the length of the effective period (the first effective period length) when the display panel 300 is driven at the first frequency. In one or more embodiments, the length of the vertical blank period (the second vertical blank period length) when the display panel 300 is driven at the second frequency may be longer than a length corresponding to two frames when the display panel 300 is driven at the first frequency. In one or more embodiments, the second vertical blank period length may be substantially equal to two times the first frame length plus the first vertical blank period length.

FIG. 6, as analogous to FIGS. 4 and 5, illustrates that the length of one frame (the second frame length) when the display panel 300 is driven at the second frequency may be substantially equal to three times the length of one frame (the first frame length) with the time when the display panel 300 is driven at the first frequency. Unlike FIGS. 4 and 5, in one or more embodiments, as illustrated in FIG. 6, the length of the effective period (the second effective period length) when the display panel 300 is driven at the second frequency is longer than the length of the effective period (the first effective period length) when the display panel 300 is driven at the first frequency, and the length of the vertical blank period (the second vertical blank period length) when the display panel 300 is driven at the second frequency is longer than the length of the effective period (the first effective period length) when the display panel 300 is driven at the first frequency. In one or more embodiments, the length of the effective period (the second effective period length) when the display panel 300 is driven at the second frequency may be substantially equal to two times the length of one frame (the first frame length) when the display panel 300 is driven at the first frequency, and the length of the vertical blank period (the second vertical blank period length) when the display panel 300 is driven at the second frequency may be substantially equal to the length of one frame (the first frame length) when the display panel 300 is driven at the first frequency. In one or more embodiments, the second effective period length may be substantially equal to the first frame length plus the first effective period length, or equal to two times the first effective period length plus the first vertical blank period length; and the second vertical blank period length may be substantially equal to the first frame length plus the first vertical blank period length, or equal to two times the first vertical blank period length plus the first effective period length. In one or more embodiments, when the still image is displayed, a driving frequency of the display panel 300 is decreased; therefore, energy consumption may be reduced. As the driving frequency is decreased, leakage current due to voltage difference between the input terminal and the output terminal of the switching element Q may be increased.

Referring back to FIG. 1, the graphic processing unit 700 transmits input image data to the signal controller 600. When the display panel 300 displays a motion picture, the graphic processing unit 700 transmits input image data to the signal controller 600 for every frame. When the display panel 300 displays a still image, since the signal controller 600 stores (using the frame memory 610) the input image data received from the graphic processing unit 700 to transmit the (stored) input image data to the display panel 300, the graphic processing unit 700 may not transmit input image data to the signal controller 600 for every frame. In one or more embodiments, when the display panel 300 displays a still image, the graphic processing unit 700 may be inactivated.

The graphic processing unit 700 may transmit a still image start signal to the signal controller 600 at a conversion time when input image data for displaying a motion picture is transmitted; subsequently, input image data for displaying a still image may be transmitted. In one or more embodiments, the signal controller 600 may recognize that a still image starts and may start to store input image data after receiving the still image start signal. The signal controller 600 may include a frame memory 610 capable of storing input image data.

The graphic processing unit 700 may transmit a still image end signal to the signal controller 600 at a conversion time when input image data for displaying a still image is transmitted; subsequently, input image data for displaying a motion picture may be transmitted. In one or more embodiments, the signal controller 600 may recognize that a motion picture starts and may start to receive input image data for every frame after receiving the still image end signal.

Although not illustrated, in one or more embodiments, the signal controller 600 may be (e.g., electrically and/or optically) connected with the graphic processing unit 700 through a main link and a secondary link. The graphic processing unit 700 may transmit input image data to the signal controller 600 through the main link. The graphic processing unit 700 may transmit a still image start signal and/or a still image end signal to the signal controller 600 through the secondary link. The signal controller 600 may transmit a notification signal (for notifying a driving state of the display panel 300) to the graphic processing unit 700 through the secondary link.

The display device may further include a gate driver 400 for driving the gate lines G1-Gn and may further include a data driver 500 for driving the data lines D1-Dm.

The gate lines G1-Gn of the display panel 300 are connected to the gate driver 400. The gate driver 400 alternately applies gate-on voltage Von and gate-off voltage Voff to the gate lines G1-Gn according to the gate control signal CONT1 applied from the signal controller 600.

The display panel 300 may include two substrates that face each other and are bonded to each other. The gate driver 400 may be attached to one side edge of the display panel 300. The gate driver 400 may be mounted on the display panel 300 together with the gate lines G1-Gn, the data lines D1-Dm, and the switching element Q. The gate driver 400 may be formed together in the process of forming the gate lines G1-Gn, the data lines D1-Dm, and the switching element Q.

The data lines D1-Dm of the display panel 300 are connected to the data driver 500. The data driver 500 receives the data control signal CONT2 and the image data DAT from the signal controller 600. The data driver 500 converts the image data DAT into data voltage using gray voltage generated from a gray voltage generator 800 and transfers the converted data voltage to the data lines D1-Dm. The image data DAT may be new image data newly received by the signal controller 600 or stored image data having been stored in the frame memory 610. The data driver 500 may receive the new image data when the display panel 300 is driven at the first frequency to display a motion picture; the data driver 500 may receive the stored image data when the display panel 300 is driven at the second frequency to display a still image.

Hereinafter, a gate voltage applied to a gate line of the display device according to one or more embodiments of the present invention will be discussed with reference to FIGS. 7 and 8.

Figure 7:
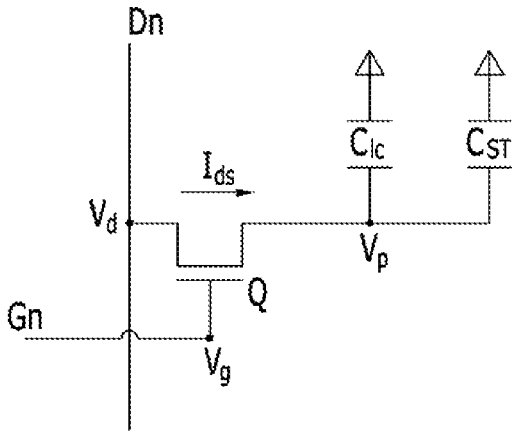
FIG. 7 is a diagram illustrating a pixel of the display device according to one or more embodiments of the present invention.

FIG. 7 is a diagram illustrating a pixel of the display device according to one or more embodiments of the present invention. FIG. 8 is a graph illustrating current between an input terminal and an output terminal in relation to gate voltage in a switching element of the display device according to one or more embodiments of the present invention.

The pixel of the display device may include a switching element Q connected to the gate line Gn and the data line Dn; the pixel may further include a liquid crystal capacitor Clc and a storage capacitor Cst both connected to the switching element Q. In one or more embodiments, a control terminal of the switching element Q is connected with the gate line Gn, an input terminal of the switching element Q is connected with the data line Dn, and an output terminal of the switching element Q is connected with the liquid crystal capacitor Clc and the storage capacitor Cst.

The gate-on voltage and the gate-off voltage are alternately applied to the gate line Gn to control an on/off state of the switching element Q.

When the gate-on voltage is applied to the gate line Gn, the switching element Q becomes in an on state, and current Ids flows between the input terminal and the output terminal of the switching element Q. Accordingly, the pixel electrode is charged to pixel voltage Vp by data voltage Vd supplied through the data line Dn.

When the gate-off voltage is applied to the gate line Gn, the switching element Q becomes in an off state, and the current Ids does not flow between the input terminal and the output terminal. Nevertheless, a voltage difference is formed between the data voltage Vd and the pixel voltage Vp; as a result, a leakage current Ids may be generated between the input terminal and the output terminal of the switching element Q even though the switching element Q is in the off state. The leakage current Ids may negatively affect the quality of the displayed image. Accordingly, it may be preferred that the voltage value of the gate-off voltage be configured to minimize the leakage current Ids.

Figure 8:
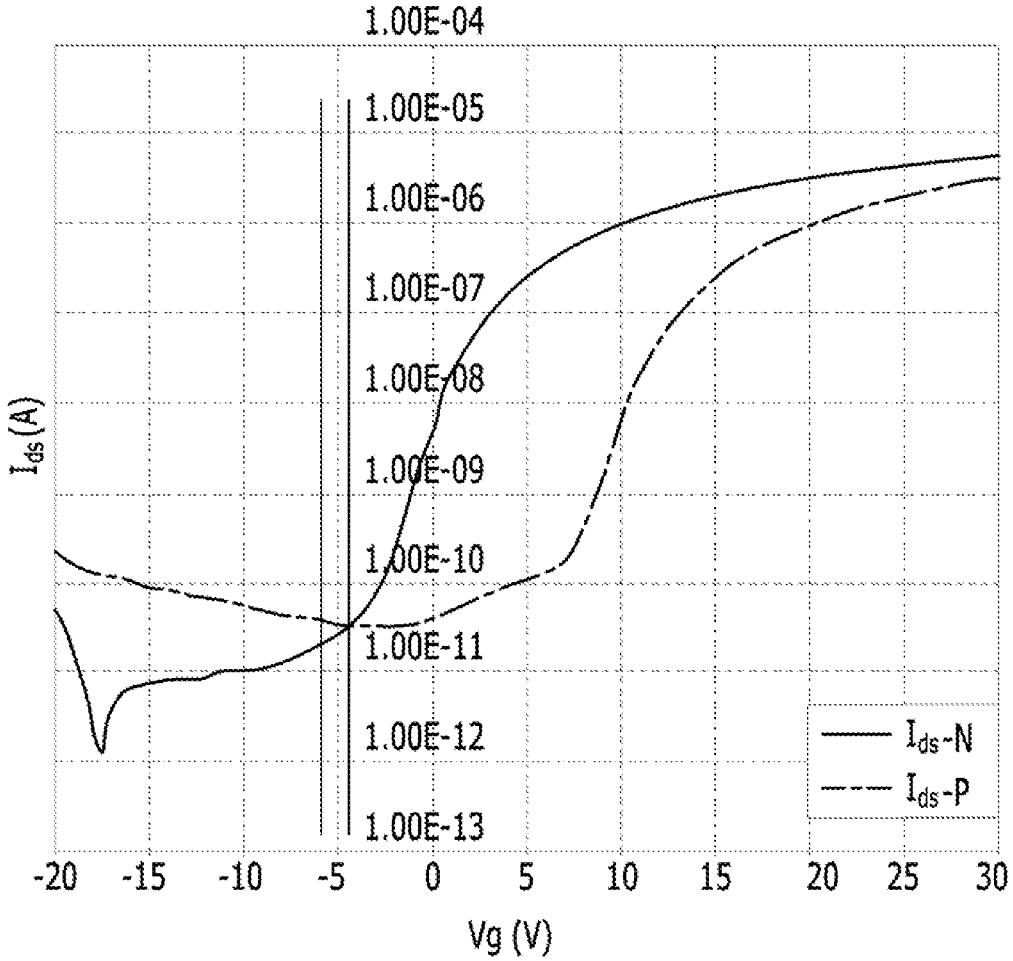
FIG. 8 is a graph illustrating current between an input terminal and an output terminal in relation to gate voltage in a switching element of the display device according to one or more embodiments of the present invention.

FIG. 8 illustrates the leakage current Ids between the input terminal and the output terminal in relation to gate voltage Vg inputted to the control terminal of the switching element Q, wherein the pixel voltage Vp may be positive with reference to the data voltage Vd and may be negative with reference to the data voltage Vd. FIG. 8 illustrates an Ids-Vg relation where the pixel voltage Vp is 0 V and the data voltage Vd is 10 V when the pixel voltage Vp is negative relative to the data voltage Vd; FIG. 8 also shows an Ids-Vg relation where the pixel voltage Vp is 20 V and the data voltage Vd is 10 V when the pixel voltage Vp is positive relative to the data voltage Vd.

If a gate-off voltage value (e.g., about −17.5 V according to FIG. 8) capable of minimizing the leakage current Ids_N is selected according to only the Ids-Vg relation where the pixel voltage Vp is negative relative to the data voltage Vd, the value of the leakage current Ids associated with a positive pixel (where the pixel voltage Vp is positive relative to the data voltage Vd) may be substantially different from the value of the leakage current Ids associated with a negative pixel (where the pixel voltage Vp is negative relative to the data voltage Vd). As a result, luminance characteristics of the positive pixel may be substantially different luminance characteristics of the negative pixel, and image quality may be unsatisfactory. If a gate-off voltage value (e.g., about −2V according to FIG. 8) capable of minimizing the leakage current Ids_P is selected according to only the Ids-Vg relation where the pixel voltage Vp is positive relative to the data voltage Vd, the value of the leakage current Ids associated with a positive pixel may be substantially different from the value of the leakage current Ids associated with a negative pixel occurs. As a result, luminance characteristics of the positive pixel and the negative pixel may be different, and image quality may be satisfactory.

In one or more embodiments, the display device is configured to use the value of the gate-off voltage that enables the value of the leakage current Ids_N (i.e., the Ids according to the Ids-Vg relation where the pixel voltage Vp is negative relative to the data voltage Vd) to be substantially equal to the value of the leakage current Ids_P i.e., the Ids according to the Ids-Vg relation where the pixel voltage Vp is positive relative to the data voltage Vd). For example, the gate-off voltage may be set to about −4 V according to FIG. 8. Optimal values of the gate-off voltage may depend on particular embodiments. Nevertheless, in one or more embodiments, an optimal value of the gate-off voltage may enable the corresponding value of the leakage current Ids_N and the corresponding value of the leakage current Ids_P to be substantially equal to each other. As a result, luminance characteristics may be substantially uniform for negative pixels and positive pixels. Advantageously, satisfactory image quality may be provided.

Hereinafter, luminance characteristic improvement according to one or more embodiments of the present invention will be discussed with reference to FIGS. 9 and 10.

Figure 9:
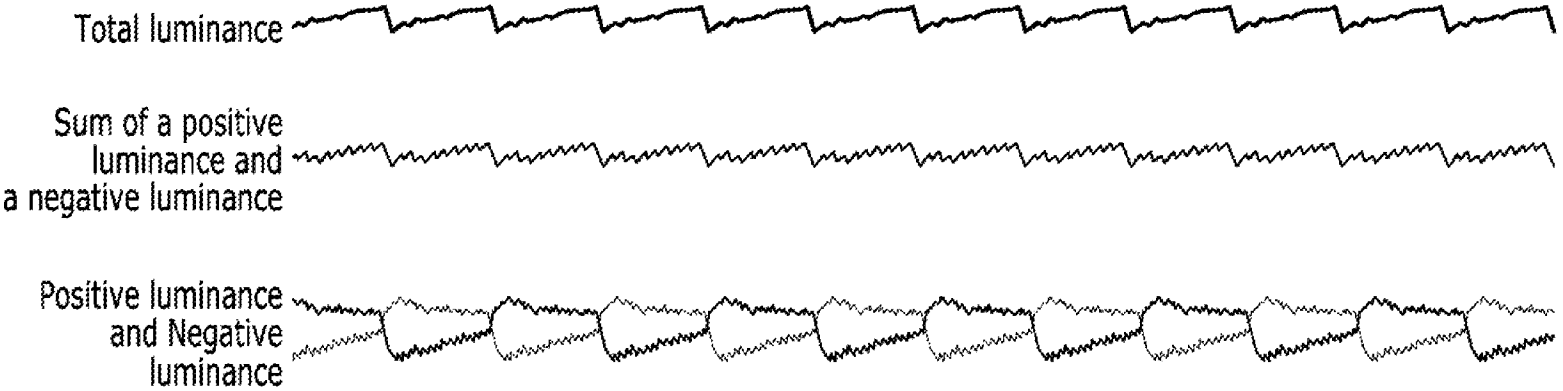
FIG. 9 is a diagram illustrating luminance characteristics when a still image is displayed in a display device according to the related art.
Figure 10:
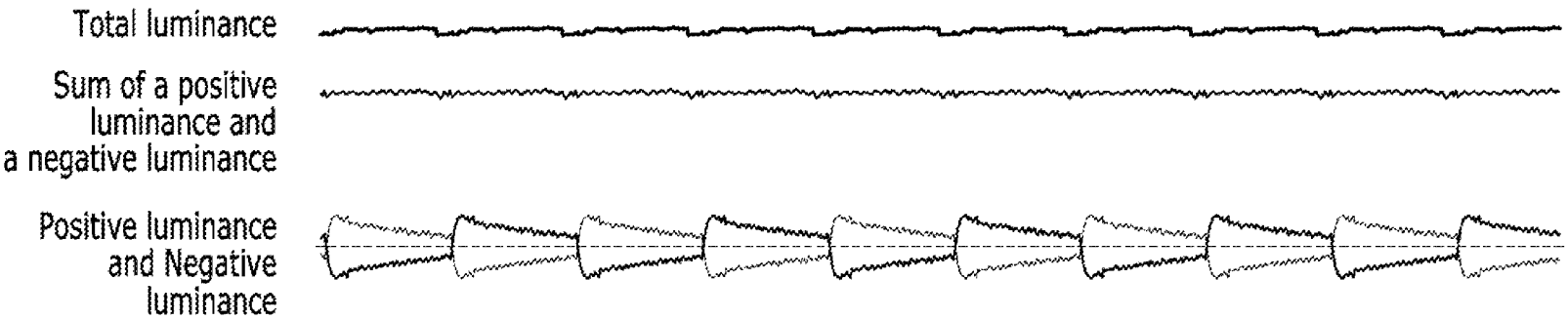
FIG. 10 is a diagram illustrating luminance characteristics when a still image is displayed in a display device according to one or more embodiments of the present invention.

FIG. 9 is a diagram illustrating luminance characteristics when a still image is displayed in a display device according to the related art. FIG. 10 is a diagram illustrating luminance characteristics when a still image is displayed in a display device according to one or more embodiments of the present invention. In detail, FIG. 9 is a diagram illustrating luminance characteristics in the case where a gate-off voltage value capable of minimizing current Ids_N between the input terminal and the output terminal of the switching element Q is selected according to only the Ids-Vg relation where the pixel voltage Vp is negative relative to the data voltage Vd. FIG. 10 is a diagram illustrating luminance characteristics in one or more embodiments where a gate-off voltage value is selected such that the leakage current Ids_N is substantially equal to the leakage current Ids_P.

Since the same image is shown for every frame when a still image is displayed, in theory, luminance of each pixel should not be changed.

As illustrated in FIG. 9, in the display device according to the related art, when a still image is displayed, the luminance of the entire screen repetitively increases and decreases for every frame, and the luminance substantially fluctuates over time. As a result, conspicuous flicker may be perceived by the viewer of the still image, and the image quality may be substantially unsatisfactory.

A cause of the flicker occurs may be that a sum value of the luminance of the positive pixel, to which the positive pixel voltage (relative to the data voltage) is applied, and the luminance of the negative pixel, to which the negative pixel voltage (relative to the data voltage) is applied, is not constant. The luminance of the positive pixel and the luminance of the negative pixel are substantially different from each other. The sum value of the luminance of the positive pixel and the luminance of the negative pixel may change for every frame, and thus the luminance of the entire screen may change for every frame.

In one or more embodiments, the gate-off voltage value is configured such that the leakage current Ids_P (where the pixel voltage Vp is positive relative to the data voltage Vd) is substantially equal to the leakage current Ids_N (where the pixel voltage Vp is negative relative to the data voltage Vd). As a result, in one or more embodiments of the present invention, the luminance of the entire screen may be uniformly maintained when the still image is displayed.

In one or more embodiments of the present invention, when the still image is displayed, the amplitude of the leakage current Ids_P generated in the positive pixel (to which a positive pixel voltage relative to a data voltage is applied) and the amplitude of the leakage current Ids_N generated in the negative pixel (to which the negative pixel voltage relative to a data voltage is applied) are substantially equal in magnitude. Given the opposite polarities of the associated luminance values, the sum value of the luminance of the positive pixel (to which the positive pixel voltage is applied) and the luminance of the negative pixel (to which the negative pixel voltage is applied) may be uniformly maintained. Accordingly, the luminance of the entire screen may be uniformly maintained. Advantageously, the viewer of the display device may not perceive conspicuous flicker, and the image quality may be satisfactory.

In one or more embodiment, the gate-off voltage value is set to be in a range that is determined based on the optimal gate-off voltage value, which enables the leakage currents Ids_P and Ids_N to be substantially equal. The gate-off voltage value in the range may achieve substantially the same effect or a similar effect of minimizing flicker as the optimal gate-off voltage value, as discussed with reference to Table 1 and FIG. 11.

Figure 11:
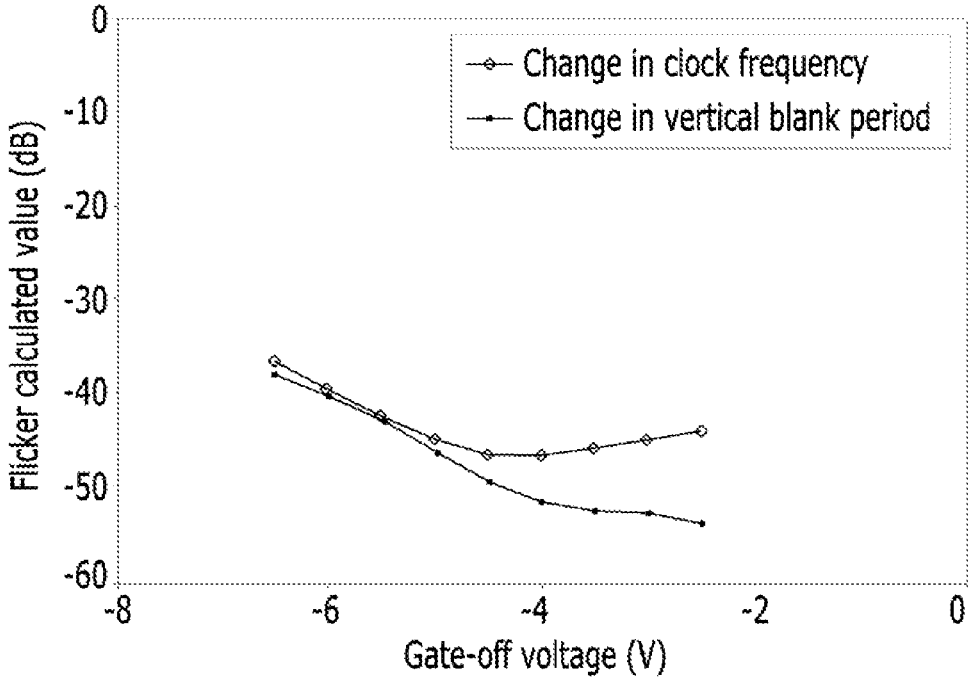
FIG. 11 is a graph illustrating a flicker value in relation to a gate-off voltage value when a still image is displayed in a display device according to one or more embodiments of the present invention.

Table 1 is a table illustrating a flicker value in relation to a gate-off voltage value when the still image is displayed in a display device according to one or more embodiments of the present invention. FIG. 11 is a diagram illustrating data in Table 1 using a graph. That is, FIG. 11 is a graph illustrating a flicker value in relation to a gate-off voltage value when a still image is displayed in the display device according to one or more embodiments of the present invention.

In one or more embodiments of the present invention, the frequency is decreased by changing at least one of the length of the vertical blank period and a magnitude of a clock frequency. Table 1 and FIG. 11 illustrate the flicker value in relation to the gate-off voltage when the still image is displayed at a low frequency.

In one or more embodiments, as illustrated in FIG. 8, for the leakage currents Ids_P and Ids_N to be substantially equal to each other, the optimal gate-off voltage value should be about −4V. Flicker values corresponding to gate-off voltage values lower than −4V and flicker values corresponding to gate-off voltage values higher than −4V are illustrated in Table 1 and FIG. 11.

TABLE 1

| Gate-off voltage (V) | Flicker value (dB) Change in vertical blank period | Change in clock frequency |
|---|---|---|
| −6.5 | −37.9 | −36.7 |
| −6 | −40 | −39.5 |
| −5.5 | −42.7 | −42.4 |
| −5 | −46.2 | −45 |
| −4.5 | −49.4 | −46.3 |
| −4 | −51.4 | −46.4 |
| −3.5 | −52.4 | −45.6 |
| −3 | −52.5 | −44.7 |
| −2.5 | −53.5 | −43.7 |

In one or more embodiments, as illustrated in Table 1 and FIG. 11, the flicker value corresponding to the optimal gate-off voltage −4V may not be substantially different from the flicker values corresponding to other gate-off voltage values that are in the range of about −20% and/or +20% deviations from −4V.

In one or more embodiments, the gate-off voltage value may be set to be about +20% or more increase from −4V, and the flicker value may negligibly increase (if the frequency is changed with change in clock frequency) or may decrease (if the frequency is changed with change in the vertical blank period length). also have a similar value to or a lower value than the flicker value when the gate-off voltage is −4V. Nevertheless, if the gate-off voltage value is very high, the leakage current may substantially increase; as a result, undesirable effects, such as decolorization, may occur.

Accordingly, in one or more embodiments, the gate-off voltage value is in the range of about −20% to +20% deviation from the optimal gate-off voltage value, which enables the leakage currents Ids_P and Ids_N to be substantially equal to each other. In one or more embodiments, the gate-off voltage is in the range of about −10% to +10% deviation from the optimal gate-off voltage value.

In one or more embodiments of the present invention, the value of the gate-off voltage applied to the gate line Gn when the display panel is driven at the second frequency may be in the range defined by Equation 1.

$$Va-0.2|Va|\leq Voff2\leq Va+0.2|Va| \quad \text{[Equation 1]}$$

(wherein Voff2 represents the gate-off voltage when the display panel is driven at the second frequency, and wherein Va represents the gate-off voltage that enables the leakage currents Ids_P and Ids_N to substantially equal.)

In one or more embodiments of the present invention, the value of the gate-off voltage applied to the gate line Gn when the display panel is driven at the second frequency may be in the range defined by Equation 2.

$$Va-0.1|Va|\leq Voff2\leq Va+0.1|Va| \quad \text{[Equation 2]}$$

(wherein Voff2 represents the gate-off voltage when the display panel is driven at the second frequency, and wherein Va represents the gate-off voltage that enables the leakage currents Ids_P and Ids_N to substantially equal.)

In one or more embodiments of the present invention, the display device is driven at a low frequency when a still image is displayed; in order to prevent conspicuous flicker, the gate-off voltage may be set according to at least one of Equation 1 and Equation 2

In one or more embodiments of the present invention, the display device is driven at a high frequency when a motion picture is displayed such that flicker may be inconspicuous. Given that flicker may be inconspicuous at a high frequency, the gate-off voltage may be set to a lower value for reducing leakage currents. In one or more embodiments, the gate-off voltage when the display panel is driven at the first frequency may be set to be lower than the gate-off voltage when the display panel is driven at the second frequency.

In one or more embodiments, the gate-off voltage when the display panel is driven at the first frequency may be set to be substantially equal to the gate-off voltage when the display panel is driven at the second frequency. In one or more embodiments, the range of the gate-off voltage for the first frequency may be represented by Equations as follows.

$$Va-0.2|Va|\leq Voff1\leq Va+0.2|Va| \quad \text{[Equation 3]}$$

(wherein Voff1 represents the gate-off voltage when the display panel is driven at the first frequency, and wherein Va represents the gate-off voltage that enables the leakage currents Ids_P and Ids_N to substantially equal.)

In one or more embodiments of the present invention, the gate-off voltage applied to the gate line Gn when the display panel is driven at the first frequency may be in the range defined by Equation 4.

$$Va-0.1|Va|\leq Voff1\leq Va+0.1|Va| \quad \text{[Equation 4]}$$

(wherein Voff1 represents the gate-off voltage when the display panel is driven at the first frequency, and wherein Va represents the gate-off voltage that enables the leakage currents Ids_P and Ids_N to substantially equal.)

Hereinafter, a method of calculating a flicker value will be described below with reference to FIGS. 12 and 13.

Figure 12:
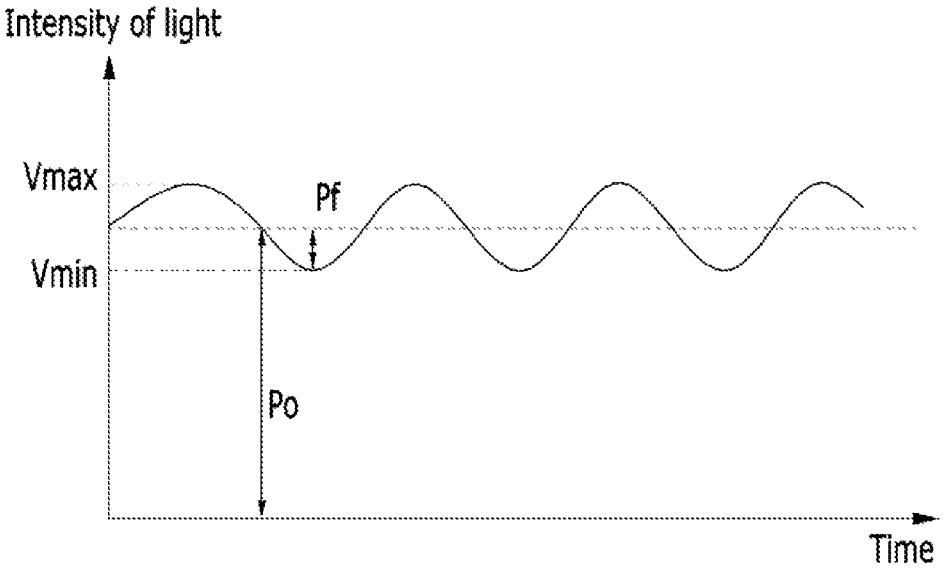
FIG. 12 is a graph illustrating intensity of light emitted from a display panel in relation to time.

FIG. 12 is a graph illustrating intensity of light emitted from a display panel in relation to a time. FIG. 13 is a diagram illustrating equipment used for flicker measurement.

The flicker means a phenomenon in which flicker of light is perceived as intensity of light emitted from a screen is not uniform and changes periodically over time. When the display device is driven at 60 Hz, flickers of 60 times per second may occur.

Referring to FIG. 12, the intensity of light may change over time. The intensity of light has a value in the range defined by Vmax and Vmin and changes periodically.

A first method of calculating a flicker value involves calculating a ratio of an AC component to a DC component. After the Vmax and Vmin values have been measured, the flicker value may be calculated using Equation 5.

$$F=\frac{\text{AC component}}{\text{DC components}}*100=\frac{Vmax-Vmin}{(Vmax+Vmin)/2}*100 \quad \text{[Equation 5]}$$

(wherein F represents the flicker value)

Since sensitivity of eyes is changed according to the intensity of light and since the change amount has nonlinearity, the sensitivity of eyes needs to be considered when the flicker value is calculated. In the first method, the change of the sensitivity of eyes is neglected for simplicity; nevertheless, the calculated flicker value may not be very accurate.

Hereinafter, a second method for calculating a more accurate flicker value will be described. The second method involves considering the change of the sensitivity of eyes.

Figure 13:
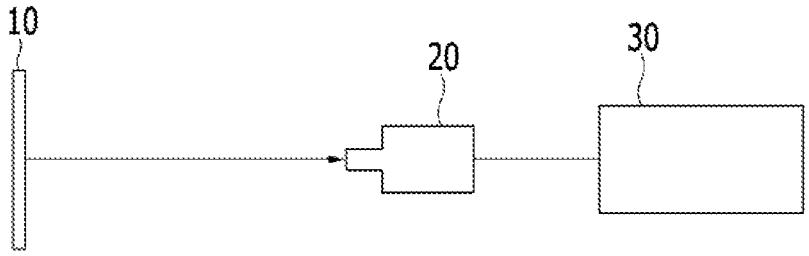
FIG. 13 is a diagram illustrating equipment used for flicker measurement.

As illustrated in FIG. 13, a luminance meter 20 capable of measuring luminance is disposed for receiving light emitted from a display device 10. In one or more embodiments, the luminance meter 20 may a BM-7 luminance meter available from Everfine Co., LTD in China. In one or more embodiments, a dynamic signal analyzer (DSA) 30, which may receive and process signals from the luminance meter 20, is connected to the luminance meter 20.

The display device 10 may controlled to a state such that light can be emitted from the display device 10 and that the luminance of the light emitted from the display device 10 is measured using the luminance meter 20. The luminance of light measured by the luminance meter 20 has an analogue value, and the analogue value is transmitted to the dynamic signal analyzer 30. The dynamic signal analyzer 30 reads a root mean square value (rms value) of the 0 Hz component and an rms value of the 30 Hz component from the analogue value by a decibel (dB) unit.

After the rms value of the 0 Hz component and the rms value of the 30 Hz component have been determined by the dynamic signal analyzer 30, the flicker value may be calculated using the following Equation 6. Equation 6 incorporates considerations of size change of pupils in relation to the intensity of light, intensity of light transmitted through pupils given the size change of the pupils, reactivity of eyes to the intensity of light transmitted through the pupils, and so on.

[Equation 6]

$$F = 1000 * (A - B)$$

(wherein $$A = \frac{\left[\pi\left(\frac{10^{0.8558-0.000401\{log(L(0\ Hz+30\ Hz))\}+0.86)^3}}{2}\right)^2 L(0\ \text{Hz} + 30\ \text{Hz})\right]^{0.74}}{\left[\pi\left(\frac{10^{0.8558-0.000401\{log(L(0\ Hz+30\ Hz))\}+0.86^3}}{2}\right)^2 L(0\ \text{Hz} + 30\ \text{Hz})\right]^{0.74} + 1584.9^{0.74}},$$

wherein $$B = \frac{\left[\pi\left(\frac{10^{0.8558-0.000401\{log(L(0\ Hz-30\ Hz))\}+0.86)^3}}{2}\right)^2 L(0\ \text{Hz} - 30\ \text{Hz})\right]^{0.74}}{\left[\pi\left(\frac{10^{0.8558-0.000401\{log(L(0\ Hz-30\ Hz))\}+0.86^3}}{2}\right)^2 L(0\ \text{Hz} + 30\ \text{Hz})\right]^{0.74} + 1584.9^{0.74}},$$

wherein $$L(0\ \text{Hz} + 30\ \text{Hz}) = \left[10^{\frac{0\ Hz(dB)+b}{20}} + 10^{\frac{30\ Hz(dB)+b}{20}}\right] / a,$$

wherein $$L(0\ \text{Hz} - 30\ \text{Hz}) = \left[10^{\frac{0\ Hz(dB)+b}{20}} - 10^{\frac{30\ Hz(dB)+b}{20}}\right] / a,$$

wherein 0 Hz represents the rms value of 0 Hz component of luminance of light, wherein 30 Hz represents rms value of 30 Hz component of luminance of light, wherein a represents a proportional constant related to luminance of light inputted to the luminance meter 20 and outputted voltage, and wherein b represents a reference voltage for calculating voltage inputted to the dynamic signal analyzer 30 by decibel (dB).)

The calculation of the second method may be more complicated than the first method. Nevertheless, according to the second method, the flicker value is calculated with more relevant parameters taken into account. Therefore, a more accurate flicker value may be calculated using the second method.

The flicker values illustrated in Table 1 and FIG. 11 are calculated using the second method.

While this invention has been described in connection with what is presently considered to be practical embodiments, it is to be understood that the invention is not limited to the disclosed embodiments. The invention is intended to cover various modifications and equivalent arrangements included within the spirit and scope of the appended claims.

<Description of Symbols>

| | |
|---|---|
| 10: Display device | 20: Luminance meter |
| 30: Dynamic signal analyzer | 300: Display panel |
| 400: Gate driver | 500: Data driver |
| 600: Signal controller | 610: Frame memory |
| 700: Graphic processing unit | 800: Gray voltage generator |

What is claimed is:

1. A display device comprising:

a data line configured to transmit a data voltage;

a display panel that includes a first pixel and a second pixel, wherein when the first pixel-has a first pixel voltage that is positive relative to the data voltage, such that the first pixel-has a first leakage current, the second pixel-has a second pixel voltage that is negative relative to the data voltage, such that the second pixel-has a second leakage current;

a gate line; and a gate driver configured to provide a first gate-off voltage having a first value through the gate line to at least one of the first pixel and the second pixel when the display panel displays a still image, the first value being in a range that is determined based on an equality-enabling value, wherein the equality-enabling value is a voltage when the first leakage current is substantially equal to the second leakage current, wherein a maximum value of the range is equal to the equality-enabling value plus 20% of an absolute value of the equality-enabling value.

2. The display device of claim 1, wherein the display panel is driven at a first frequency when a motion picture is displayed, and wherein the display panel is driven at a second frequency lower than the first frequency when the still image is displayed.

3. The display device of claim 1, wherein a minimum value of the range is equal to the equality-enabling value minus 20% or 10% of the absolute value of the equality-enabling value.

4. The display device of claim 1, wherein the first value is equal to the equality-enabling value.

5. The display device of claim 1, wherein the gate driver is further configured to provide a second gate-off voltage having a second value through the gate line to the at least one of the first pixel and the second pixel when the display panel displays a motion picture, and wherein the second value is lower than the first value.

6. The display device of claim 1, wherein the gate driver is further configured to provide a second gate-off voltage having a second value through the gate line to the at least one of the first pixel and the second pixel when the display panel displays a motion picture, and wherein the second value is in the range.

7. The display device of claim 1, wherein the gate driver is further configured to provide a second gate-off voltage having a second value through the gate line to the at least one of the first pixel and the second pixel when the display panel displays a motion picture, and wherein the second value is equal to the first value.

8. The display device of claim 1, wherein the first pixel includes a switching element that includes an input terminal and an output terminal, and wherein the first leakage current exists between the input terminal and the output terminal when the switching element receives the first gate-off voltage.

9. The display device of claim 1, wherein the still image is associated with a first frame length and a first vertical blank period length, wherein the display panel is configured to display a motion picture that is associated with a second frame length and a second vertical blank period length, and wherein the first vertical blank period length is equal to a sum of two times the second frame length and the second vertical blank period length.

10. The display device of claim 1, wherein the still image is associated with a first frame length and a first effective period length, and wherein the display panel is configured to display a motion picture that is associated with a second frame length and a second effective period length, wherein the first effective period length is equal to a sum of the second frame length and the second effective period length.

11. A method for configuring a display device, the method comprising:

providing a data line for transmitting a data voltage;

providing a display panel that includes a first pixel and a second pixel, wherein when the first pixel-has a first pixel voltage that is positive relative to the data voltage, such that the first pixel-has a first leakage current, the second pixel-has a second pixel voltage that is negative relative to the data voltage, such that the second pixel-has a second leakage current;

providing a gate line;

providing a gate driver for supplying a first gate-off voltage having a first value through the gate line to at least one of the first pixel and the second pixel when the display panel displays a still image; and setting the first value such that the first value is in a range that is determined based on an equality-enabling value, wherein the equality-enabling value is a voltage when the first leakage current is substantially equal to the second leakage current, wherein a maximum value of the range is equal to the equality-enabling value plus 20% of an absolute value of the equality-enabling value.

12. The method of claim 11, further comprising:

driving the display panel at a first frequency when the display panel displays a motion picture; and driving the display panel at a second frequency lower than the first frequency when the still image is displayed.

13. The method of claim 11, wherein a minimum value of the range is equal to the equality-enabling value minus 10% or 20% of the absolute value of the equality-enabling value.

14. The method of claim 11, further comprising setting the first value such that the first value is equal to the equality-enabling value.

15. The method of claim 11, wherein the gate driver is further configured to provide a second gate-off voltage having a second value through the gate line to the at least one of the first pixel and the second pixel when the display panel displays a motion picture, the method further comprising: setting the second value such that the second value is lower than the first value.

16. The method of claim 11, wherein the gate driver is further configured to provide a second gate-off voltage having a second value through the gate line to the at least one of the first pixel and the second pixel when the display panel displays a motion picture, the method further comprising: setting the second value such that the second value is in the range.

* * * * *